US009581420B2

(12) United States Patent
Siewertsz Van Reesema

(10) Patent No.: US 9,581,420 B2
(45) Date of Patent: Feb. 28, 2017

(54) PROJECTILE SYSTEM INCLUDING A PROJECTILE MOUNT AND A PROJECTILE

(71) Applicant: Fergus William Siewertsz Van Reesema, Kyneton (AU)

(72) Inventor: Fergus William Siewertsz Van Reesema, Kyneton (AU)

( * ) Notice: Subject to any disclaimer, the term of this patent is extended or adjusted under 35 U.S.C. 154(b) by 0 days.

(21) Appl. No.: 14/768,623

(22) PCT Filed: Mar. 19, 2014

(86) PCT No.: PCT/AU2014/000294

§ 371 (c)(1),
(2) Date: Aug. 18, 2015

(87) PCT Pub. No.: WO2014/146170

PCT Pub. Date: Sep. 25, 2014

(65) Prior Publication Data

US 2016/0003591 A1 Jan. 7, 2016

(30) Foreign Application Priority Data

Mar. 19, 2013 (AU) ..... 2013900957

(51) Int. Cl.

| | |
|---|---|
| ***F42B 10/00*** | (2006.01) |
| ***F42B 12/02*** | (2006.01) |
| ***F42B 5/02*** | (2006.01) |
| ***F42B 10/26*** | (2006.01) |
| ***F42B 30/02*** | (2006.01) |
| ***F42B 5/067*** | (2006.01) |
| *F42B 10/24* | (2006.01) |

(52) U.S. Cl.

CPC ..... *F42B 12/02* (2013.01); *F42B 5/02* (2013.01); *F42B 5/067* (2013.01); *F42B 10/26* (2013.01); *F42B 30/02* (2013.01); *F42B 10/24* (2013.01)

(58) Field of Classification Search

CPC ..... F42B 12/02; F42B 30/02; F42B 10/24; F42B 10/26; F42B 10/38; F41A 21/18

See application file for complete search history.

(56) References Cited

U.S. PATENT DOCUMENTS 3,741,069 A * 6/1973 Stewart ..... F41A 9/35 89/11
3,808,973 A * 5/1974 Galluzzi ..... F42B 5/08 102/376
3,859,922 A * 1/1975 Kaplan ..... F42B 14/062 102/521
4,176,487 A 12/1979 Manis
(Continued)

FOREIGN PATENT DOCUMENTS

EP 0 359 946 A1 3/1990

OTHER PUBLICATIONS

International Search Report mailed May 26, 2014, issued in PCT/AU2014/000294, filed Mar. 19, 2014, 5 pages.

*Primary Examiner* — Michael David
(74) *Attorney, Agent, or Firm* — Seed IP Law Group LLP

(57) ABSTRACT

A projectile and a projectile mount having a central bore into which the projectile is mounted and includes rotational formations functionally engaging between the projectile and the projectile mount which in use provides rotational motion to the projectile around an axis of rotation by the propulsion of the projectile along the axis of rotation.

20 Claims, 9 Drawing Sheets

(56) References Cited

U.S. PATENT DOCUMENTS

| | | | | | |
|---|---|---|---|---|---|
| 4,356,769 | A * | 11/1982 | Galluzzi | F42B 15/00 | 102/380 |
| 4,546,564 | A * | 10/1985 | A'Costa | F41A 21/02 | 42/76.01 |
| 4,712,465 | A | 12/1987 | Macdonald | | |
| 4,911,079 | A * | 3/1990 | Sauvestre | F42B 14/061 | 102/439 |
| 5,164,538 | A * | 11/1992 | McClain, III | F42B 10/24 | 102/501 |
| 5,725,179 | A * | 3/1998 | Gilman | F42B 10/24 | 102/439 |
| 5,988,071 | A * | 11/1999 | Taylor | F42B 12/06 | 102/388 |
| 6,662,726 | B1 * | 12/2003 | Steiner | F42B 12/06 | 102/517 |
| 2002/0134273 | A1 | 9/2002 | Mihaylov et al. | | |
| 2006/0065149 | A1 | 3/2006 | Gilman et al. | | |
| 2007/0089628 | A1 | 4/2007 | Elder | | |
| 2011/0024550 | A1 * | 2/2011 | McDermott | F42B 10/44 | 244/3.27 |
| 2011/0155016 | A1 | 6/2011 | Marx | | |

* cited by examiner

A
$T_H$
11
22
26
29
19
25
23
24
27

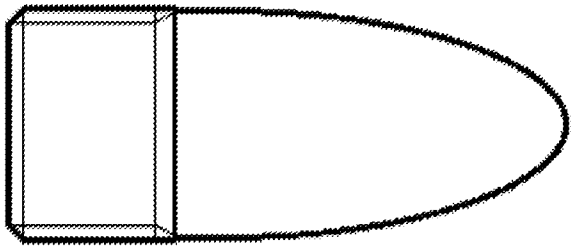
FIG 6A
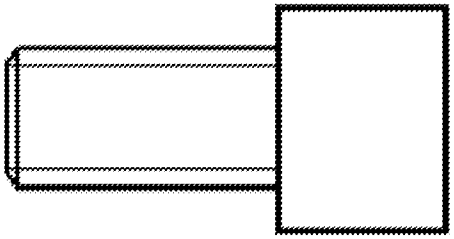
FIG 6B
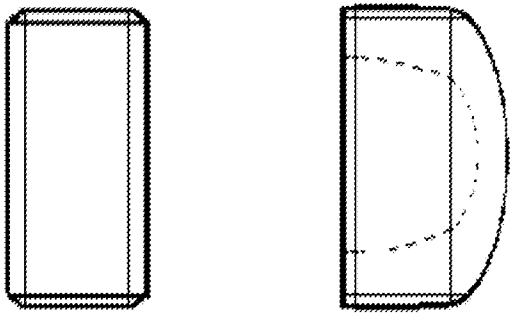
FIG 6C
FIG 6D
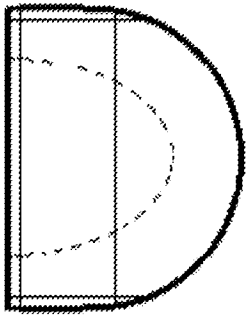
FIG 6E
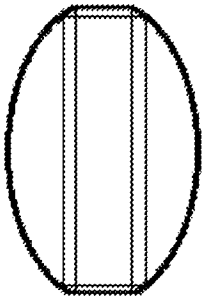
FIG 6F

PROJECTILE SYSTEM INCLUDING A PROJECTILE MOUNT AND A PROJECTILE

BACKGROUND

Technical Field

The present invention relates to a projectile and in particular to a projectile that is fired from a chamber such as a bullet.

The invention has been developed primarily for use in a gun or rifle without the need of an elongated barrel mount and will be described hereinafter with reference to this application. However, it will be appreciated that the invention is not limited to this particular field of use and in particular could relate to projectiles in medical fields or other engineering fields.

Description of the Related Art

It is known that elongated projectiles generally need a spin in order to stabilize the projectile in flight and to impart a degree of accuracy in the direction of the flight. A primary mechanism for achieving this has been the creation of a rifling barrel in which the inside of the barrel is shaped with an inwardly extending helical curve coaxial with the axis of the barrel. The bullet is sized to match the bore diameter of the barrel so that when the bullet is propelled down the barrel, the inwardly extending helical curve of the barrel provides a frictional force on the travelling bullet sufficient by the end of the barrel to impart rotational spin to the bullet around its longitudinal axis.

A substantial problem with this process is the loss of energy by the frictional force and blow by leakage gases. Although there is the benefit of bullets being mass produced to generally fit the barrel, the bullet has to be sufficiently malleable relative to the inwardly extending helical curve of the barrel. This results in the bullet receiving rifling marks caused by deformations and stripping of material from the bullet, as well as loss of energy by frictional heat. A substantial increase of projectile energy is needed to compensate for the losses, and choices and costs of material substantially hinder ready construction.

The present disclosure seeks to provide a projectile that will overcome or substantially ameliorate at least one or more of the deficiencies of the prior art, or to at least provide an alternative.

It is to be understood that, if any prior art information is referred to herein, such reference does not constitute an admission that the information forms part of the common general knowledge in the art, in Australia or any other country.

BRIEF SUMMARY

According to a first aspect of the present disclosure, a projectile is provided for use with a projectile mount having a central bore, the projectile including an elongate body having a maximum diameter which corresponds substantially to the bore diameter of the projectile mount, a front portion forming an aerodynamic front of the projectile, and a rear portion having a substantially cylindrical rear portion which includes at least a first part of rotational formation that engages with a second part of rotational formation of projectile mount to provide rotational motion around an axis of rotation to the projectile upon the projectile being propelled along the axis of rotation.

The rotational formation can be an outer thread of the projectile so as to functionally engage with an inner thread forming rotational formation of the projectile mount.

Preferably the thread diameter corresponds substantially to the bore diameter of the projectile mount.

Preferably the projectile mount is a bullet cartridge for including an explosive charge.

The projectile mount can be an explosive mount such as a cannon having a closed end bore in which in use the explosive charge is rearward of the projectile in the bore.

In at least one embodiment, the diameter of the body of the projectile at the front is greater than the bore diameter of the projectile mount.

In another embodiment, the diameter of the body of the projectile at the front is substantially equal to or less than the bore diameter of the projectile mount.

The diameter of the body of the projectile at the rear is substantially equal to the bore diameter of the projectile mount.

The projectile can have a front symmetrical projectile portion of the body starting at a central point.

The projectile can have a rear portion in a decreasing aerodynamic shape like the stern of a boat.

The present disclosure also provides a projectile and a projectile mount having a central bore into which the projectile is mounted and includes rotational formations functionally engaging between the projectile and the projectile mount which in use provides rotational motion to the projectile around an axis of rotation by the propulsion of the projectile along the axis of rotation.

The projectile mount can include an ignition channel leading to a propulsion chamber formed by a rear portion of the central bore behind the projectile. Alternatively, the central bore is an inner blind bore.

The rotational formations retain the projectile at least partially in the projectile mount.

Preferably the rotational formations retain the projectile only partially in the projectile mount while a front portion of the projectile protrudes from the projectile mount, and a rear portion of the projectile and the inner bore of the projectile mount include the functionally-engaging rotational formations.

The rotational formations can form a vortex outlet for explosive energy to form a gaseous bearing between the projectile and the projectile mount. Preferably the explosive energy is a controlled explosion in the projectile mount behind the projectile. The explosive energy and the rotational formations can form a vortex which in use provides the rotational motion to the projectile around an axis of rotation by the propulsion of the projectile along the axis of rotation.

Preferably the rotational formation includes at least partial rotations totaling 3 to 10 rotations.

The rotational formations can include first portion on the inner/outer surface of the projectile and a second functionally engaging portion on the corresponding outer/inner surface of the projectile mount so as to hold the projectile to the projectile mount.

The mounting of the projectile and the projectile mount is preferably provided by the functionally engaging of the projectile and projectile mount portions being connected in a loose fit sufficient to allow propulsion gas to leave the propulsion chamber between the rotational formation portions to provide a gaseous bearing while allowing the interaction of rotational formation portions of the projectile and projectile mount to engage so as to provide rotational motion around an axis of rotation to the projectile by the propulsion of the projectile along the axis of rotation.

The interaction of rotational formation portions of the projectile and projectile mount can include at least partial overlapping with gaseous spacing between the projectile and projectile mount.

Preferably the functionally engaging of the projectile and projectile mount portions are connected in a loose fit sufficient according to:

$$B-2TB<C+2TC$$

where the bore diameter B less twice the inwardly extending thread height TB is less than the projectile cylinder diameter C plus twice the outwardly extending thread height TC.

The functional engagement of the rotational formation portions of the projectile and projectile mount can preferably provide a minimal spacing between the projectile and projectile mount.

Preferably the functional engagement of the rotational formation portions of the projectile and projectile mount is aided by spacers to assist with a minimal spacing between the projectile and projectile mount.

The functional engagement of the projectile and projectile mount portions is relatively sized to allow a build-up of pressure behind the projectile, gaseous leakage flow between the projectile and projectile mount portions to form a gaseous bearing, and a vortex rotational propulsion of the projectile from the projectile mount.

The present disclosure also provides a projectile for use with a projectile mount having a central bore, the projectile including an elongate body having a maximum diameter which corresponds substantially to the bore diameter of the projectile mount, a front portion forming an aerodynamic front of the projectile, and a rear portion having a substantially cylindrical rear portion which includes at least a first part of a rotational formation that engages with a second part of the rotational formation on the projectile mount to provide rotational motion around an axis of rotation to the projectile as the projectile is propelled along the axis of rotation, wherein the rotational formations form a retaining hold of the projectile within the projectile mount, and wherein the rotational formations form a vortex outlet for explosive energy in the projectile mount behind the projectile to form a gaseous bearing between the projectile and the projectile mount and to impart vortex rotational drive on the projectile to enact explosive expulsion.

The first part of the rotational formation can be an outer thread of the projectile so as to functionally engage with an inner thread forming the second part of the rotational formation on the projectile mount.

The thread diameter can correspond substantially to the bore diameter of the projectile mount.

Preferably the projectile mount is a bullet cartridge for including an explosive charge.

Preferably the projectile mount is an explosive mount such as a cannon barrel having a closed end bore in which in use the explosive charge is rearward of the projectile in the bore.

Preferably, in at least one embodiment, the diameter of the body of the projectile at the front is greater than the bore diameter of the projectile mount. Preferably, in another embodiment, the diameter of the body of the projectile at the front is substantially equal to or less than the bore diameter of the projectile mount.

Preferably the diameter of the body of the projectile at the rear is substantially equal to the bore diameter of the projectile mount.

The projectile can have a front symmetrical projectile portion of the body starting at a central point forming an aerodynamic projectile shape. It also can have a rear portion in a decreasing aerodynamic shape.

Preferably the projectile has the cumulative thread bearing area at an initial state, which can be reached by the propellant gases around periphery of projectile and within projectile mount, that is substantially equal to the sectional area of the projectile not including the thread bearing area.

The bearing area can be greater than the sectional area.

The projectile can form a unitary bullet.

The present disclosure also provides a method of launching a projectile by mounting the projectile in a projectile mount with a rotational mount such that the rotational mount provides rotational motion of the projectile around an axis of rotation corresponding to the linear direction of propulsion of the projectile.

A method of launching a projectile can include the steps of:

- providing a rear portion having a substantially cylindrical shape to form a projectile mount;
- having at least a first part of a rotational formation that functionally engages with a second part of rotational formation of projectile mount;
- propelling the projectile along a linear axis of propulsion; and
- incurring rotational motion of the projectile around an axis of rotation corresponding to the linear direction of propulsion of the projectile.

Preferably the rotational formations form a retaining hold of the projectile within the projectile mount.

Preferably the rotational formations form a vortex outlet for explosive energy in the projectile mount behind the projectile to form a gaseous bearing between the projectile and the projectile mount and to impart vortex rotational drive on the projectile to enact explosive expulsion.

Preferably the single constraint of the volute causes the propellant and projectile to rotate freely as a combined system without fouling the gaseous bearing.

Preferably a secondary projectile is incorporated with the primary projectile to allow sequential operation and thereby cascadence of propulsion.

Other aspects of the invention are also disclosed.

BRIEF DESCRIPTION OF THE SEVERAL VIEWS OF THE DRAWINGS

Notwithstanding any other forms which may fall within the scope of the present invention, preferred embodiments of the disclosure will now be described, by way of example only, with reference to the accompanying drawings in which:

FIGS. 6A to 6F are various shapes of projectiles in accordance with other preferred embodiments of the present disclosure.

DETAILED DESCRIPTION

Figures 1A, 1B:
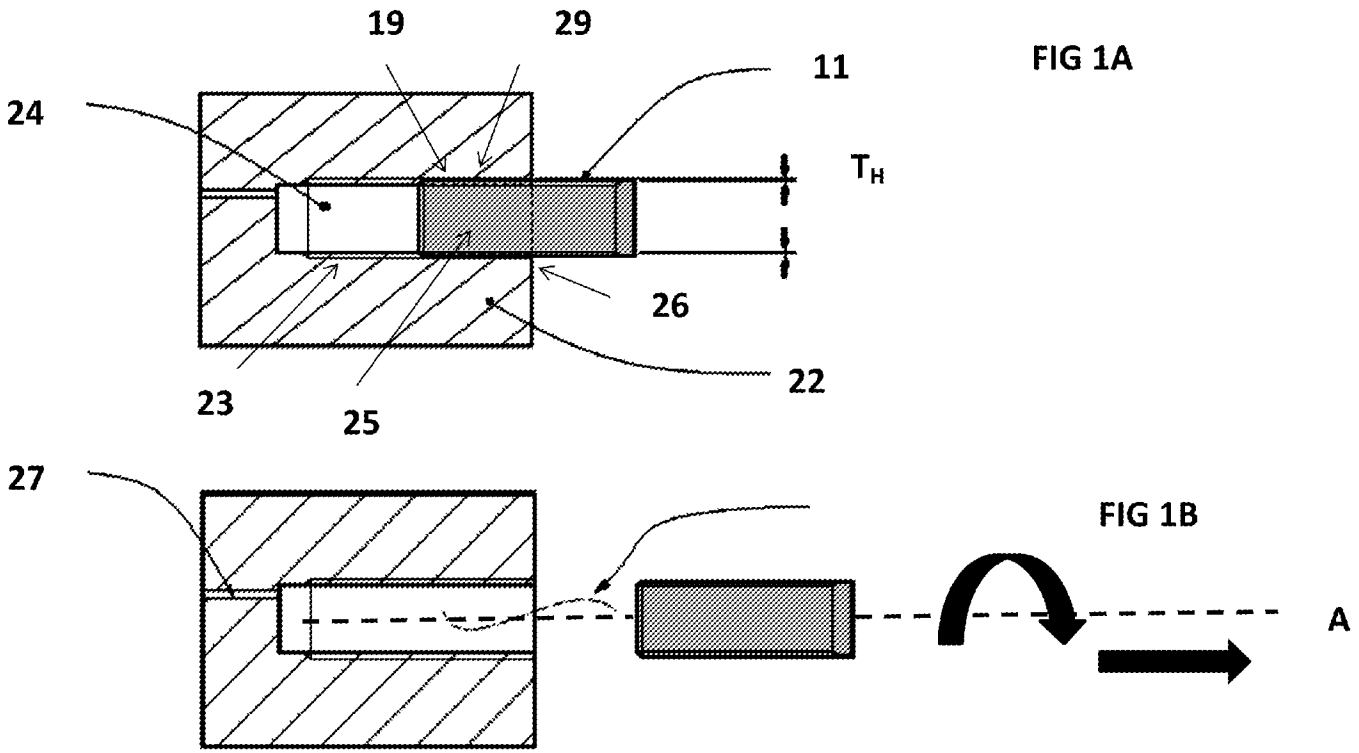
FIGS. 1A and 1B are diagrammatic cross sectional views of a projectile in use with a projectile mount in accordance with a preferred first embodiment of the present disclosure in a first state before initial propulsion of the projectile and a second state after initial propulsion of the projectile.

It should be noted in the following description that like or the same reference numerals in different embodiments denote the same or similar features.

Referring to FIGS. 1A and 1B, a projectile 11 is for use with a projectile mount 22.

The projectile mount 22 has a central bore 23 being a substantially consistent cylindrical form extending from an inner propulsion chamber 224 to a mounting chamber 25 and exiting the projectile mount 22 at the outer exit 26.

The projectile 11 includes an elongate body having a maximum diameter which corresponds substantially to the bore diameter of the projectile mount. The elongate body can have a front portion 12 forming an aerodynamic front of the projectile, and a rear portion 13 having a substantially cylindrical rear portion.

There is included a first part of a rotational formation 19 on an outer side of the substantially cylindrical rear portion 13 that functionally engages with a second part of a rotational formation 29 of projectile mount 22 to provide rotational motion around an axis of rotation A to the projectile upon the projectile being propelled along the axis of rotation. That axis of rotation A is the axis of the cylindrical central bore 23 of the projectile mount 22.

The projectile 11 and the projectile mount 22 having a central bore 23 into which the projectile 11 is mounted and including the rotational formations 29, 19 functionally engaging between the projectile and the projectile mount in use provides rotational motion to the projectile around an axis of rotation and the propulsion of the projectile along the axis of rotation.

The projectile mount 22 includes an ignition channel 27 leading from the rear of the projectile mount 22 to the propulsion chamber 24 formed by a rear portion of the central bore 23 behind the projectile 11.

The rotational formation holds the projectile to the projectile mount not in a frictional mode but retains in a functionally engaging interaction, wherein the rotational formation includes a first portion on the inner/outer surface of the projectile and a second functionally-engaging portion on the corresponding outer/inner surface of the projectile mount so as to hold the projectile to the projectile mount. In particular, the functionally engaging of the projectile and projectile mount portions are connected in a loose fit sufficient to allow propulsion gas to leave the propulsion chamber between the rotational formation portions 19, 29 to provide a gaseous bearing while allowing the interaction of rotational formation portions of the projectile and projectile mount to provide a vortex along the helical passage between the rotational formation portions 19, 29 and engage so as to provide rotational motion to the projectile around an axis of rotation A and propulsion of the projectile along the axis of rotation.

It can be seen that:

$$B-2T_B<C+2T_C$$

where the bore diameter B less 2× the inwardly extending thread height $T_B$ is less than the projectile cylinder diameter C plus 2× the outwardly extending thread height $T_C$.

In this way there is functionally engaging of the threads $T_B$ and $T_C$. However, the functionally engaging is a loose functionally engaging such that an explosion in the propulsion chamber will result in a primary flow of gases along a small tortuous path forming a volute between the functionally engaging of the threads $T_B$ and $T_C$ so as to effect a gaseous bearing effect to reduce frictional engagement while the functionally engaging of the threads $T_B$ and $T_C$ still effects rotational motion as the secondary major expulsion of the explosion from the propulsion chamber propels the projectile out of the projectile mount.

Figure 2A:
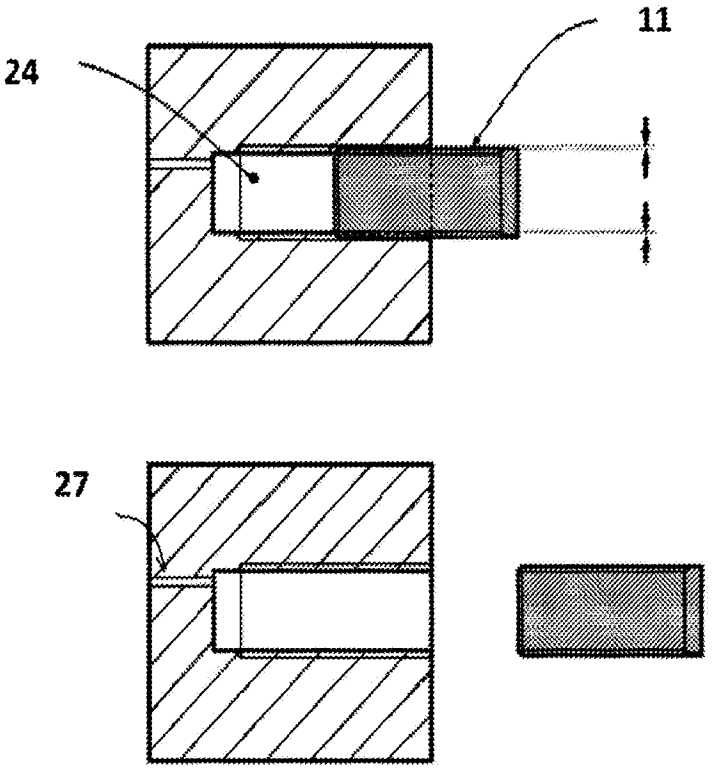
FIGS. 2A and 2B are perspective views of the projectile in use with a projectile mount of FIGS. 1A and 1B in a first state before initial propulsion of the projectile and a second state after initial propulsion of the projectile.
Figure 2B:
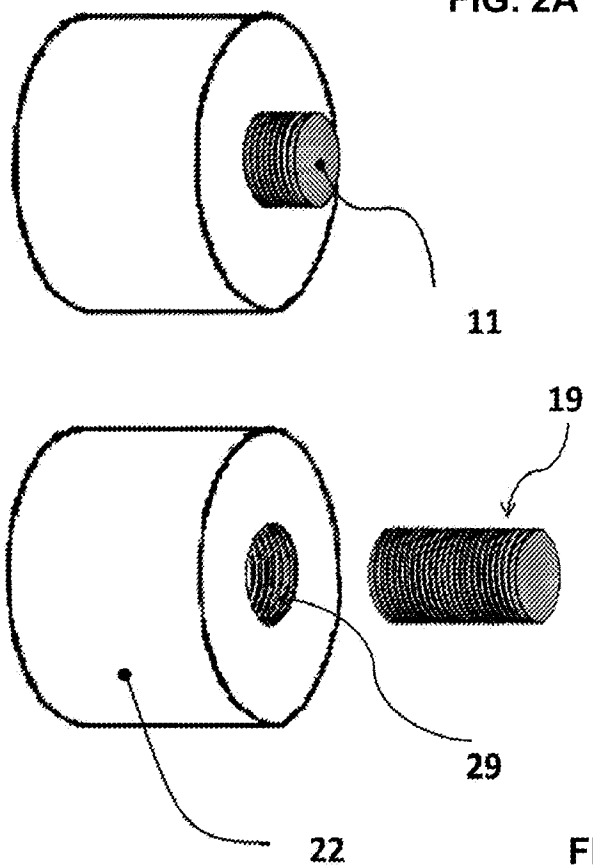

As shown more clearly in perspective drawings of FIGS. 2A and 2B, the rotational formation 19 of the projectile 11 is an outer helical thread so as to functionally engage with an inner helical thread 29 of the projectile mount 22 which together are functionally engaging portions forming the rotational formation 19, 29 of the projectile 11 and the projectile mount 22.

In particular, the interaction of rotational formation portions 19, 29 of the projectile and projectile mount include at least partial overlapping threads with minimal spacing $T_H$ between the projectile and projectile mount. This forms a helical pathway wherein the minimal spacing $T_H$ provides functionally engaging of the projectile and projectile mount portions that are relatively sized to allow a build-up of pressure in the propulsion chamber 24 behind the projectile 11, and gaseous leakage flow between the projectile and projectile mount portions forms a gaseous bearing and a vortex rotational propulsion of the projectile 11 from the projectile mount 22.

Figure 3A:
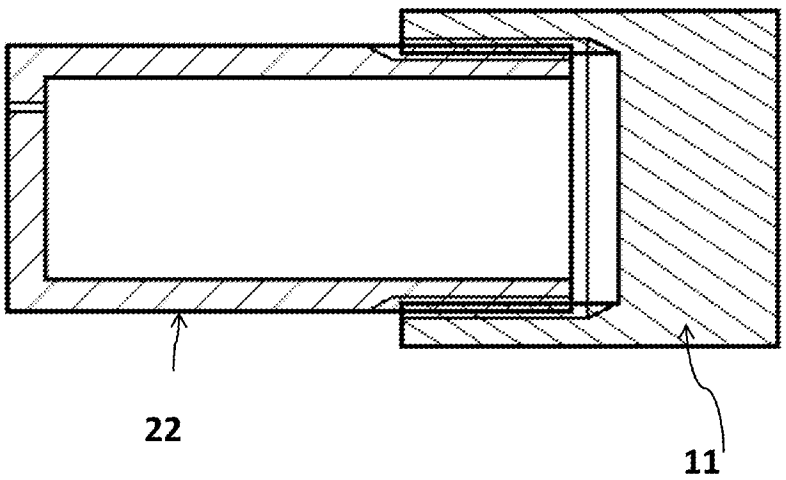
FIGS. 3A and 3B are diagrammatic cross sectional views of a projectile in use incorporated with a projectile mount forming a bullet cartridge in accordance with a preferred second embodiment of the present disclosure in a first state before initial propulsion of the projectile and a second state after initial propulsion of the projectile.
Figure 3B:
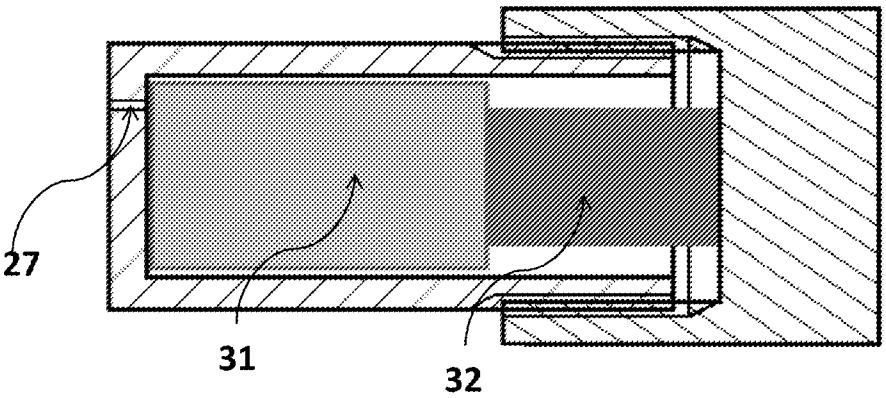

In another form as shown in FIGS. 3A and 3B, there is shown a cartridge with a projectile 11 fitting on an outer side of the cartridge in a rotational mount arrangement such as functionally engaging threads 19, 29. The cartridge has inner central bore which houses two propellants 31, 32 such that an ignition channel 27 leading to the central bore 23 ignites the first propellant 31 which then can explosively activate the second higher energy explosive 32 which thereby imparts energy to the projectile in flight. The rotational mount provides rotational motion vortex around an axis of rotation A to the projectile and the propulsion of the projectile along the axis of rotation.

Figure 4A:
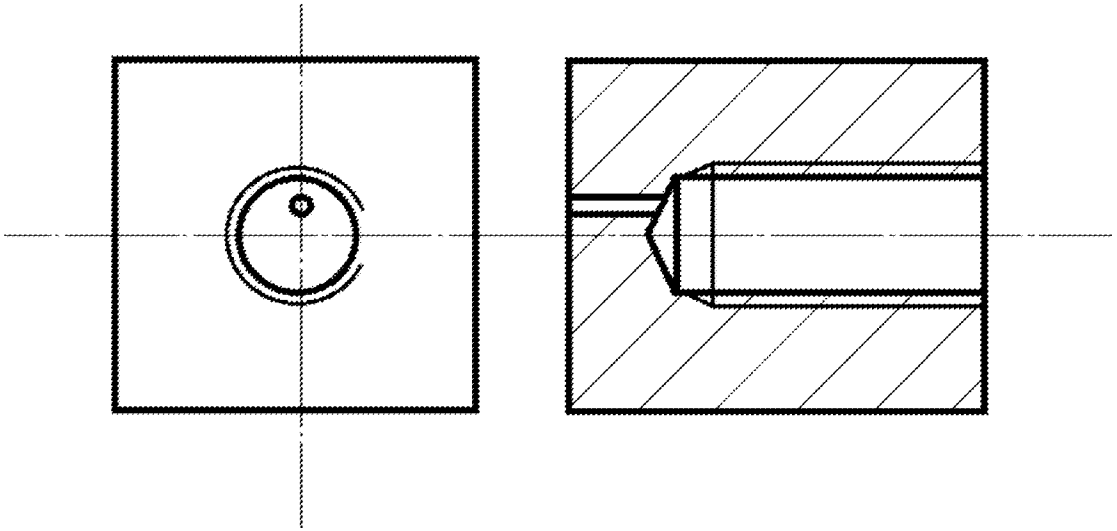
FIGS. 4A and 4B are diagrammatic cross sectional and end views of a projectile mount for use with a projectile of a bullet cartridge shown in diagrammatic cross sectional and end views in FIGS. 4C and 4D and 4E in accordance with a preferred third embodiment of the present disclosure.
Figure 4B:
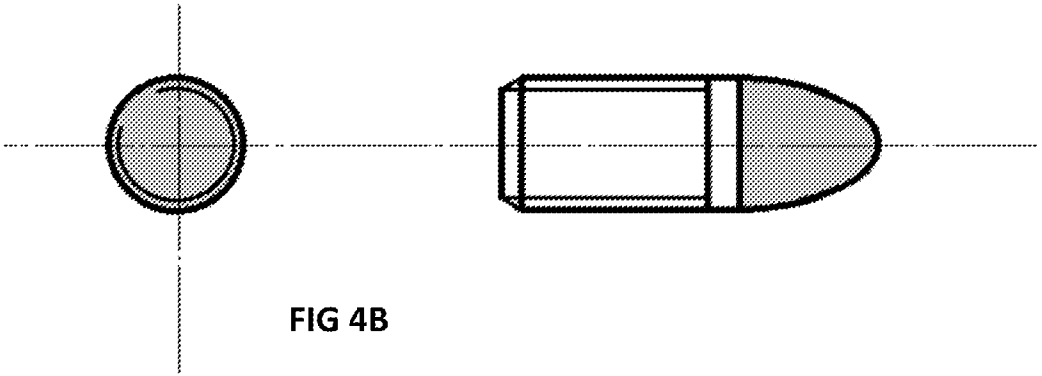
Figure 4C:
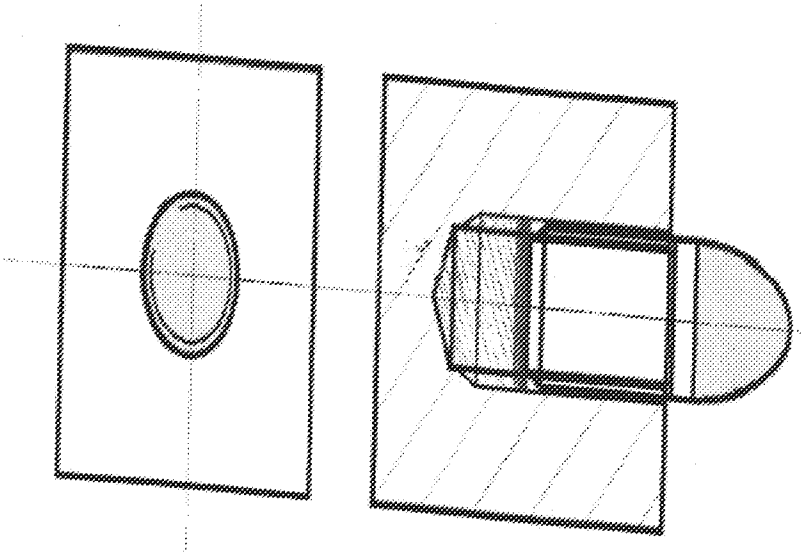
Figure 4D:
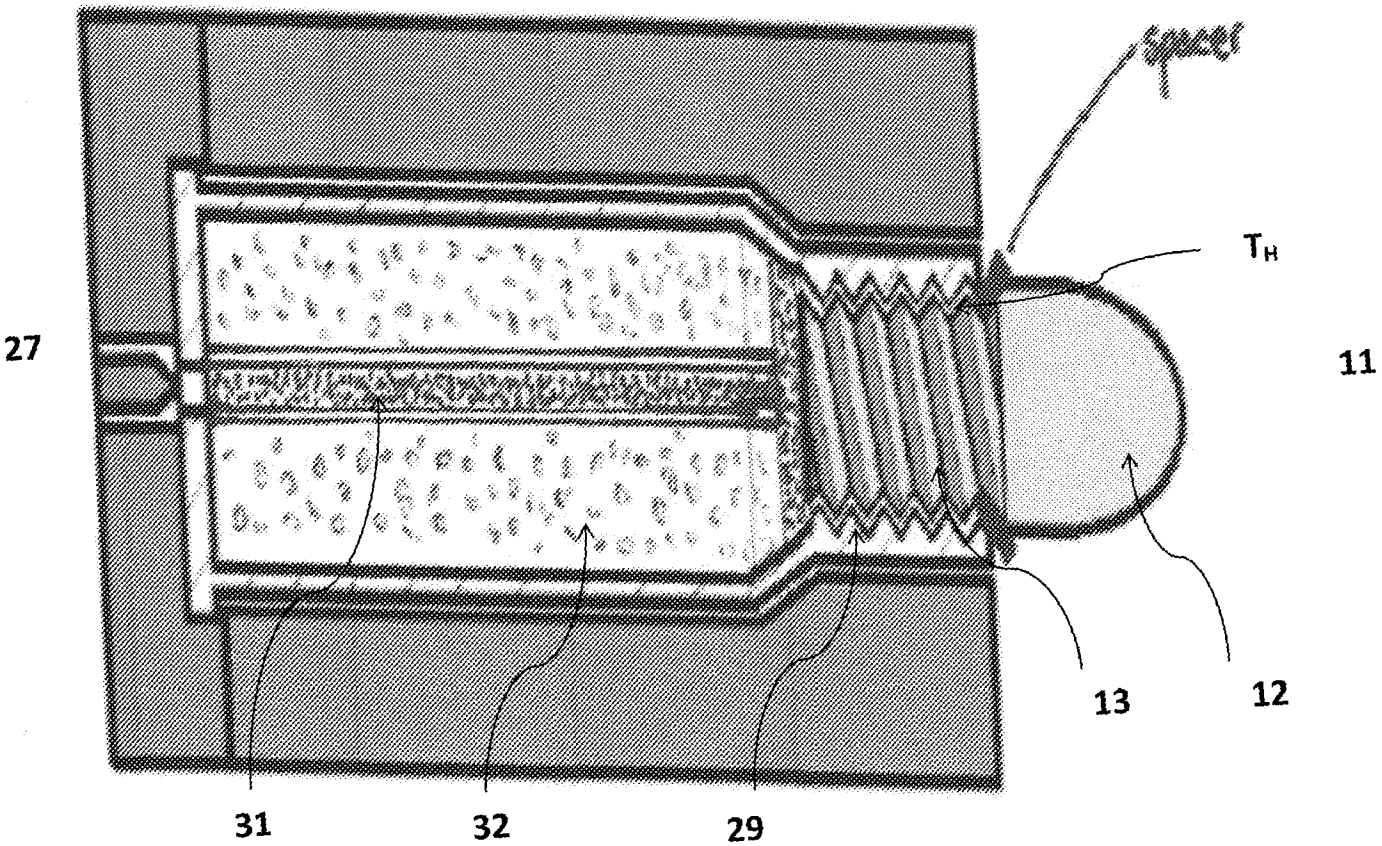
Figure 4E:
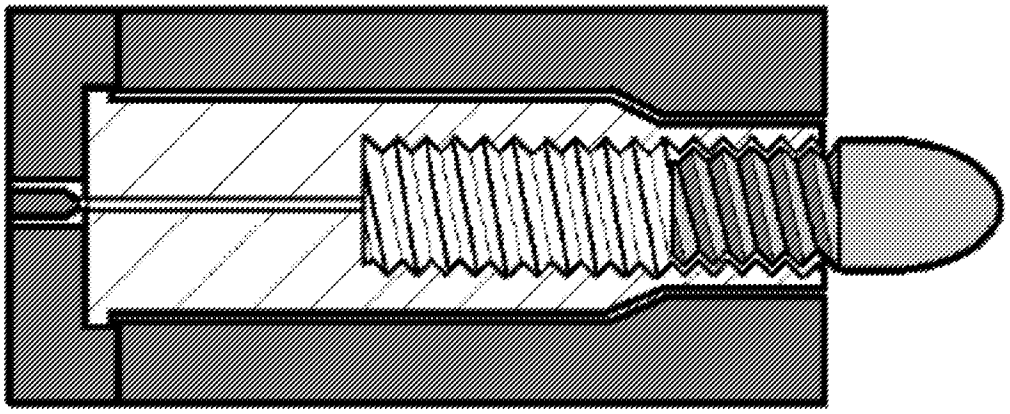

As shown in FIGS. 4C, 4D, and 4E, the projectile can be a bullet cartridge for including an explosive charge and engaging with projectile mount 4A and 4B.

These examples show the particular difference to rifling. Rifling comprises a barrel with an inner helical formation with the barrel extending in front of an explosive section. In essence, the bullet is shot into the barrel and as the bullet bounces around down the barrel the inner shaping of the barrel slowly imparts a rotational motion. However, as the bullet bounces off the inner side of the barrel, the bullet must be formed of material which is softer than the barrel so as to not split or deform the barrel. The bullet therefore is stripped of material. This loss of material and bouncing down the barrel loses substantial kinetic energy.

In particular, as shown in the projectile or bullet 11 of FIG. 4D being mounted partially within the central bore of the projectile mount of FIG. 4B, the bullet has nothing in front of it. The bullet can be made of material comparable to the projectile mount and instantly there is less loss of kinetic energy by elimination of loss of material and loss of bouncing in a barrel. Still further, ranges of different relative strength materials can be used if the fitting is sufficient to create the gaseous type bearing where friction between the rotational mounts of the projectile and projectile mount is substantially reduced.

Figure 5A:
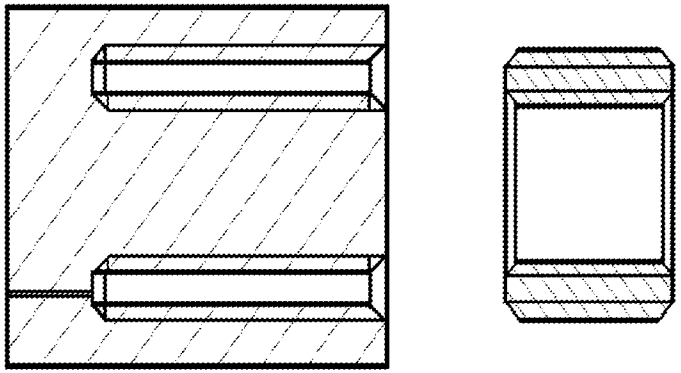
FIGS. 5A and 5B are diagrammatic cross sectional views of a projectile mount for use with a ring shaped projectile in accordance with a preferred fourth embodiment of the present disclosure.
Figure 5B:
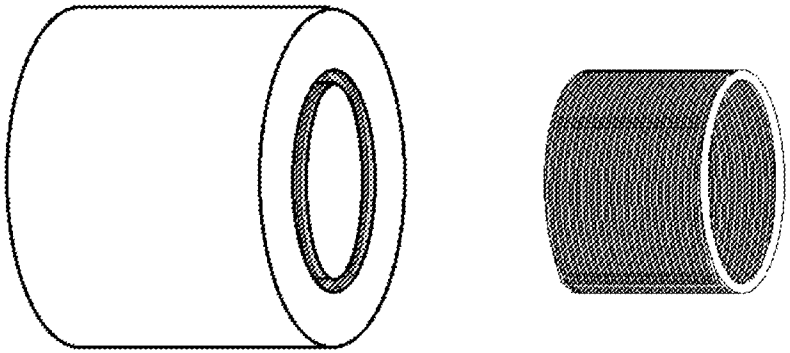

FIGS. 5A and 5B show a projectile mount 22 for use with a ring shaped projectile 11. Further, the projectiles can vary in shape such as shown in FIGS. 6A to 6F where there are various shapes of projectiles in accordance with the present disclosure. FIG. 6A shows an extended torpedo shaped front body 12 with a cylindrical rear body 13 having the rotational formations. FIG. 6B shows a block front body 12 with a smaller diameter cylindrical rear body 13 having the rotational formations. FIG. 6C has virtually minimal front body 12 with a cylindrical rear body 13 having the rotational formations. FIGS. 6D and 6E have a front curved body 12 with a cylindrical hollow rear body 13 having the rotational formations. FIG. 6F has an ovate overall shape with a central rear body 12 having the rotational formations with the front body 11 on either side to form a symmetric body that could be mounted frontwards or rearwards.

In effect, the projectile mounted partially in the projectile mount undertakes the steps of:

the rotational formations forming a retaining hold of the projectile within the projectile mount; and the rotational formations forming a vortex outlet for explosive energy in the projectile mount behind the projectile to form a gaseous bearing between the projectile and the projectile mount and to impart vortex rotational drive on the projectile to enact explosive expulsion.

The explosive energy is a controlled explosion in the projectile mount behind the projectile and the explosive energy and the rotational formations form a vortex which in use provides the rotational motion to the projectile around an axis of rotation by the propulsion of the projectile along the axis of rotation.

The projectile mount can also be an explosive mount such as a cannon having a closed end bore in which in use the explosive charge is rearward of the projectile in the bore.

In use, the projectile and projectile mount use the propulsion force and mount to provide torque and thrust energy to the projectile to propel the projectile while imparting an axial rotational motion along the direction of propulsion.

For example:

| Thread | Projectile Weight | Charge | Charge Weight | Ignition Method | Observations |
|---|---|---|---|---|---|
| 5 mm | 2 g | Phosphorus | 0.015 g | Impact | penetration in clay similar to .22" rifle |
| 8 mm | 20 g | Phosphorus | 0.05 g | Impact | penetration in clay similar to .303" rifle |
| 12 mm | 50 g | Phosphorus | 0.10 g | Impact | passed through target |
| 16 mm | 85 g | Phos + primer | 0.20 g | Impact | passed through target |
| 25 mm | 320 g | Phos + primer + ANFO | 1.5 g | Impact | vertical flight time >5 min |

It is believed the present disclosure takes advantage of three principles that enhance the efficiency of projectiles formed according to the disclosure.

The first principle is that materials are considerably more resistant to change when impacted upon at higher velocities.

The second principle is that boundary layer effects of moving fluids allow for both high and low pressures due to adhesion and viscosity principles. This allows a gaseous substantially frictionless bearing.

The third principle is that the vortex rotational drive force maximizes direct propulsion due to rotation of the projectile with minimal energy loss.

In at least one embodiment, the present disclosure provides a method of launching a projectile including the steps of:

a) providing a reusable projectile mount and a projectile with the projectile mount having a central bore with a bore diameter;

b) having at least a first part of a rotational formation that functionally engages with a second part of rotational formation of projectile mount wherein the functional engaging of the projectile and projectile mount portions are connected in a loose fit sufficient so that the rotational formations form a retaining hold of the projectile within the projectile mount but allow propulsion gas to leave the propulsion chamber between the rotational formation portions to provide a gaseous bearing, and wherein the interaction of the rotational formation portions of the projectile and projectile mount and the propulsion of the projectile along the axis of rotation engage so as to provide rotational motion around an axis of rotation to the projectile by initiating a vortex rotational motion; and c) causing an explosion wherein the interaction of rotational formation portions of the projectile and projectile mount include at least partial overlapping with gaseous spacing between the projectile and projectile mount;

d) wherein the rotational formations form a vortex outlet for explosive energy in the projectile mount behind the projectile to form a gaseous bearing between the projectile and the projectile mount and to impart vortex rotational drive on the projectile to enact explosive expulsion;

e) whereby the projectile is propelled along a linear axis of propulsion, incurring rotational motion of the projectile around an axis of rotation corresponding to the linear direction of propulsion of the projectile.

The rotational formations may form a retaining hold of the projectile within the projectile mount. The single constraint of the volute may cause the propellant and projectile to rotate freely as a combined system without fouling the gaseous bearing. Furthermore, a secondary projectile may be incorporated with the primary projectile to allow sequential operation and thereby cascadence of propulsion.

Interpretation

Embodiments:

Reference throughout this specification to "one embodiment" or "an embodiment" means that a particular feature, structure, or characteristic described in connection with the embodiment is included in at least one embodiment of the present disclosure. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the disclosure, various features of the disclosure are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Specific Details

In the description provided herein, numerous specific details are set forth. However, it is understood that embodiments of the present disclosure may be practiced without these specific details. In other instances, well-known methods, structures and techniques have not been shown in detail in order not to obscure an understanding of this description.

Terminology

In describing the preferred embodiment of the disclosure illustrated in the drawings, specific terminology will be resorted to for the sake of clarity. However, the disclosure is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Comprising and Including

In the claims which follow and in the preceding description, except where the context requires otherwise due to express language or necessary implication, the word "comprise" or variations such as "comprises" or "comprising" are used in an inclusive sense, i.e., to specify the presence of the stated features but not to preclude the presence or addition of further features in various embodiments of the disclosure.

Any one of the terms "including," "which includes," or "that includes" as used herein is also an open term that also means including at least the elements/features that follow the term, but not excluding others. Thus, "including" is synonymous with and means "comprising."

Scope of Invention

Thus, while there has been described what are believed to be the preferred embodiments of the disclosure, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

INDUSTRIAL APPLICABILITY

It is apparent from the above, that the arrangements described are applicable to the projectile industries.

The claims defining the invention are as follows:

1. A projectile system comprising:

a reusable projectile mount having a central helical bore with a bore diameter; and a projectile including:

an elongate body having a maximum diameter which corresponds substantially to the bore diameter of the projectile mount, and the projectile mount and the projectile having loose complementary interfitting thread bearing areas forming a rotational formation, a front portion of the projectile forming an aerodynamic front, and a rear portion of the projectile having a substantially cylindrical rear portion which includes at least a first part of the rotational formation having part of the loose complementary interfitting thread bearing areas that engages with a second part of the rotational formation on the projectile mount having another part of the loose complementary interfitting thread bearing areas to provide rotational motion around an axis of rotation to the projectile as the projectile is propelled along the axis of rotation;

wherein minimal spacing provides functional engaging of the projectile and projectile mount portions which are relatively sized to allow a build-up of pressure behind the projectile and gaseous leakage flow between the projectile and projectile mount portions to form a gaseous bearing;

wherein by functional engaging, the projectile and projectile mount portions are connected in a loose fit sufficient so that the rotational formations form a retaining hold of the projectile within the projectile mount but allow propulsion gas to leave the propulsion chamber between the rotational formation portions to provide the gaseous bearing;

wherein the interaction of the rotational formation portions of the projectile and projectile mount and the propulsion of the projectile along the axis of rotation engage so as to provide rotational motion around the axis of rotation to the projectile by initiating a vortex rotational motion;

wherein the interaction of the rotational formation portions of the projectile and projectile mount include at least partial overlapping with gaseous spacing between the projectile and projectile mount; and wherein the rotational formations form a vortex outlet for explosive energy in the projectile mount behind the projectile to form a gaseous bearing between the projectile and the projectile mount and to impart vortex rotational drive on the projectile to enact explosive expulsion.

2. A projectile system according to claim 1 wherein the projectile mount includes an ignition channel leading to a propulsion chamber formed by a rear portion of the central bore behind the projectile.

3. A projectile system according to claim 1 wherein the central bore is an inner blind bore and wherein the rotational formations retain the projectile at least partially in the projectile mount.

4. A projectile system according to claim 1, wherein the rotational formations retain the projectile only partially in the projectile mount while a front portion of the projectile protrudes from the projectile mount and a rear portion of the projectile and the inner bore of the projectile mount includes the functionally engaging rotational formations.

5. A projectile system according to claim 4, wherein the rotational formations each form a helical pathway and interact to form co-acting helical threads with the rotational formations starting at the rear of the projectile and extending towards the front of the projectile sufficient to extend to the front of the projectile mount when mounted in the projectile mount with the projectile mount having the co-acting helical thread, wherein the rotational formations form a vortex outlet for explosive energy to form a gaseous bearing between the projectile and the projectile mount.

6. A projectile system according to claim 5, wherein the explosive energy is a controlled explosion in the projectile mount behind the projectile.

7. A projectile system according to claim 6, wherein the explosive energy and the rotational formations form a vortex which in use provides the rotational motion to the projectile around an axis of rotation by the propulsion of the projectile along the axis of rotation.

8. A projectile system according to claim 1, wherein the rotational formation includes at least partial rotations totaling 3 to 10 rotations.

9. A projectile system according to claim 1, wherein the functionally engaging of the projectile and projectile mount portions are connected in a loose fit sufficient according to:

$$B-2T_B<C+2T_C$$

where the bore diameter B less twice the inwardly extending thread height $T_B$ is less than the projectile cylinder diameter C plus twice the outwardly extending thread height $T_C$.

10. A projectile system according to claim 1 wherein the gaseous leakage flow between the projectile and projectile mount portions form a vortex rotational propulsion of the projectile from the projectile mount.

11. A projectile system according to claim 1, wherein the first part of the rotational formation is an outer thread of the projectile so as to functionally engage with an inner thread forming the second part of the rotational formation on the projectile mount.

12. A projectile system according to claim 11, wherein the thread diameter corresponds substantially to the bore diameter of the projectile mount.

13. A projectile system according to claim 1, wherein the projectile mount is a bullet cartridge for including an explosive charge.

14. A projectile system according to claim 1, wherein the projectile mount is an explosive mount such as a cannon barrel having a closed end bore in which in use the explosive charge is rearward of the projectile in the bore.

15. A projectile system according to claim 1, wherein the projectile has a front symmetrical projectile portion of the body starting at a central point forming an aerodynamic projectile shape.

16. A projectile system according to claim 1, wherein the projectile has a rear portion in a decreasing aerodynamic shape.

17. A projectile system according to claim 1, wherein the cumulative thread bearing area at initial state, which can be reached by the propellant gases around periphery of projectile and within projectile mount, is substantially equal to the sectional area of the projectile not including the thread bearing area.

18. A projectile system according to claim 10, wherein the bearing area is greater than the sectional area.

19. A projectile system according to claim 1, wherein the projectile is a unitary bullet.

20. A method of launching a projectile, comprising:

mounting the projectile in a reusable projectile mount with a rotational mount that provides rotational motion of the projectile around an axis of rotation corresponding to a linear direction of propulsion of the projectile, the projectile mount having a central helical bore with a bore diameter, and the projectile including:

an elongate body having a maximum diameter which corresponds substantially to the bore diameter of the projectile mount, and the projectile mount and the projectile having loose complementary interfitting thread bearing areas forming a rotational formation, a front portion of the projectile forming an aerodynamic front, and a rear portion of the projectile having a substantially cylindrical rear portion which includes at least a first part of the rotational formation having part of the loose complementary interfitting thread bearing areas that engages with a second part of the rotational formation on the projectile mount having another part of the loose complementary interfitting thread bearing areas to provide rotational motion to the projectile around the axis of rotation as the projectile is propelled along the axis of rotation, wherein minimal spacing provides functional engaging of the projectile and projectile mount portions which are relatively sized to allow a build-up of pressure behind the projectile and gaseous leakage flow between the projectile and projectile mount portions to form a gaseous bearing, and wherein by functional engaging, the projectile and projectile mount portions are connected in a loose fit sufficient so that the rotational formations form a retaining hold of the projectile within the projectile mount but allow propulsion gas to leave the propulsion chamber between the rotational formation portions to provide the gaseous bearing; and launching the projectile through the central helical bore of the projectile mount, wherein the interaction of the rotational formation portions of the projectile and projectile mount and the propulsion of the projectile along the axis of rotation engage so as to provide rotational motion around the axis of rotation to the projectile by initiating a vortex rotational motion;

wherein the interaction of the rotational formation portions of the projectile and projectile mount include at least partial overlapping with gaseous spacing between the projectile and projectile mount; and wherein the rotational formations form a vortex outlet for explosive energy in the projectile mount behind the projectile to form a gaseous bearing between the projectile and the projectile mount and to impart vortex rotational drive on the projectile to enact explosive expulsion.

* * * * *